United States Patent [19]

Radtke et al.

[11] Patent Number: 4,494,256

[45] Date of Patent: Jan. 22, 1985

[54] MOTORIZED POOL COVER

[75] Inventors: Carl T. Radtke; Ewald A. Kaiser, both of Chicago; Siegfried M. Biedermann, Cary; Rick J. Chapman, Vernon Hills, all of Ill.

[73] Assignee: IBG International, Prairie View, Ill.

[21] Appl. No.: 432,775

[22] Filed: Oct. 4, 1982

[51] Int. Cl.[3] ..... E04H 3/19

[52] U.S. Cl. ..... 4/502; 74/89.2; 242/158.2

[58] Field of Search ..... 4/488, 496, 498, 500, 4/502, 503; 49/26–28; 160/193; 74/89.2–89.22; 242/86.52, 158.2

[56] References Cited

U.S. PATENT DOCUMENTS

| | | | |
|---|---|---|---|
| Re. 25,078 | 11/1961 | McGuire | 4/502 |
| 1,408,463 | 3/1922 | Miles | 254/374 |
| 2,617,315 | 11/1952 | McClelland | 242/89.2 |
| 3,451,463 | 6/1969 | Lyman | 160/193 |
| 3,499,478 | 3/1970 | Schneider | 160/193 |
| 3,549,907 | 12/1970 | Werts | 200/47 |
| 3,615,065 | 10/1971 | Elliot | 254/374 |
| 3,747,132 | 7/1973 | Foster | 4/502 |
| 3,781,738 | 12/1973 | Rozelle | 242/158.2 |
| 3,844,062 | 10/1974 | Daugirdas | 49/28 |

*Primary Examiner*—Stephen Marcus
*Attorney, Agent, or Firm*—Fitch, Even, Tabin & Flannery

[57] ABSTRACT

A pool cover sheet has beaded edges guided in side edge guides along the pool. The cover sheet is wound onto and pulled from a spool mounted on a motor driven shaft. The cover sheet is pulled by the spool by cords traveling along the side edge guides with cords being wound onto and from cord drums.

The velocity of the cover sheet travel is attempted to be matched to the cover sheet velocity by means frustoconical drums having tapered surfaces onto which the cords are wound and unwound. To attempt to equalize the tension in the cords as well as in the cover sheet, the spools and drums are driven through opposed torsion springs from a common main shaft. The tension in the respective sides of the sheet or in the respective cords may be adjusted to take up any slack found to occur. A traversing cord handling carriage moves in timed relationship to the velocity of the cord travel and lays the cord onto or takes it from the tapered drum surface at a velocity matched to velocity of the cord traveling in the side edge guides or at the front of the cover sheet.

5 Claims, 9 Drawing Figures

14
36
30
23
2
2
24
26
12
44
28
32
28
32
44
10
34
18
20
30
16
59
60

MOTORIZED POOL COVER

The present invention relates to covers for swimming pools or the like and more particularly to apparatus for automatically pulling the cover sheet alternately in a pool covering direction and a pool uncovering direction.

It has been increasingly common for owners of swimming pools to cover their pools when not in use. Pool covers provide safety, insuring that a small child or other person will not fall into an unattended pool, promote pool upkeep by keeping leaves and other debris out of the pool and save energy by preventing heat from escaping from the pool. The area covered by a typical swimming pool is substantial, and the sheets, which cover such a substantial area and have sufficient strength to support the weight of a person or persons who fall thereon or the weight of water which may accumulate thereon, may be quite heavy.

A pool cover arrangement which has proven to have several advantages includes a reel, to which the cover sheet is attached to one end and wound around, and a trolley, that spans the pool and to which the other or free end of the cover sheet is attached. The reel is driven by the rotating shaft of a motor and the trolley is connected to the shaft via cables or cords wound about drums associated with the shaft and entrained around direction-changing pulley wheels at the pool end opposite the reel. The trolley is pulled toward the reel when the shaft rotates to reel in the sheet and is pulled away from the reel when the shaft rotates to pay out the sheet. A recognized problem with such an arrangement is that as the cover sheet is unreeling from the reel, the cables are reeling onto the drums and vice versa. Thus while the sheet reel is decreasing in diameter the cable reel is increasing the diameter and vice versa.

Usually, the maximum diameter of the cover reel is substantially greater than the maximum diameter of the cord reel. Also, various drags on the pool cover due to water or frictional sliding on the pool walls, frictional resistance of the cables at bends or turns and through the guides, and folds in the cover sheet make for non-uniform tension forces on the opposite sides of the cover sheet. Non-uniform tension forces and differences in cable and cover sheet diameters cause difficulties in reeling or unreeling the cover sheet across the pool.

Various means of approaching the problem of reel and spool speed differential have been proposed. In U.S. Pat. No. 3,747,132, resilient means are provided in the interconnection between the reels and the spool through the cords and sheet. In one instance, stretchable cords are used. In another instance, the drums, on which the cords are wound, are drivably connected to the shaft by torsion springs that expand and contract to allow a rotational speed differential between the shaft and the drums in an attempt to maintain tension on the cord and pool cover. But once the motor was shut off, the springs turned the reel and the tension was lost.

The cover sheet is wider than the pool, and when it is wound onto the reels some folds occur to provide localized areas of double thickness of sheet. The folds vary in location and size. The varying patterns of folds formed in the reeling sheet may be caused by foreign objects, such as leaves, being entrapped in the sheet reel or excessive frictional drag on one side of the sheet.

As a safety measure, electrical switches, by which pool drive mechanisms operate, typically are constructed so that the switch must be manually held by an operator, i.e., the switches are deadman's switches, so that if an unsatisfactory condition exists, such as a person being observed within the pool, or gross miswinding of the sheet occurs, the motor stops as soon as the operator removes his hand from the switch as he goes to remedy the situation. It is typical with such hand-held switches to provide indicia on the sheets to indicate to the operator the extreme covering and uncovering positions.

It is further known to employ limit switches to stop the motor when the sheet has been reeled or unreeled to its extreme positions so that even if the operator is completely inattentive, as may often occur if a child is operating the mechanism, the sheet will not be over reeled or over extended. However, limit switches have not been found to work as well on such pool cover mechanisms as would be desired. If the limit switch is operable upon a predetermined number of rotations of the motor shaft, the sheet is likely to stop in its reeled or extended position with different amounts of sheet reeled onto the spool on each cycle due to the differences in reel size that develop during different cycles.

It has been proposed to secure switch operating projections onto the cover sheet for tripping limit switches supported from the deck of the pool at a fixed vertical height relative to the cover sheet. However, it has been found that in such limit switch arrangements, varying folding patterns of the sheet on each cycle may actuate the limit switches to provide a stopping of the sheet reeling or unreeling. Such systems have not proved satisfactory.

Accordingly, it is primary object of the present invention to provide improved mechanism for reeling and unreeling a new and improved cover sheet for a swimming pool or the like.

A further object of the invention is to provide a new and improved limit switch means for a pool cover system.

These and other advantages of the present invention are set forth in the following detailed description of the drawings in reference to the accompanying drawings in which.

Figure 4A:
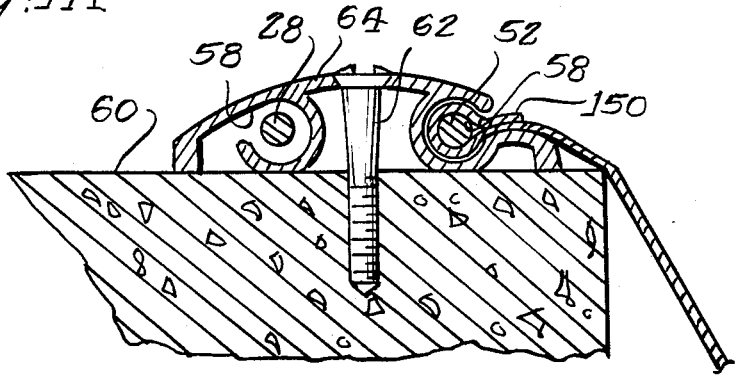
Figure 4C:
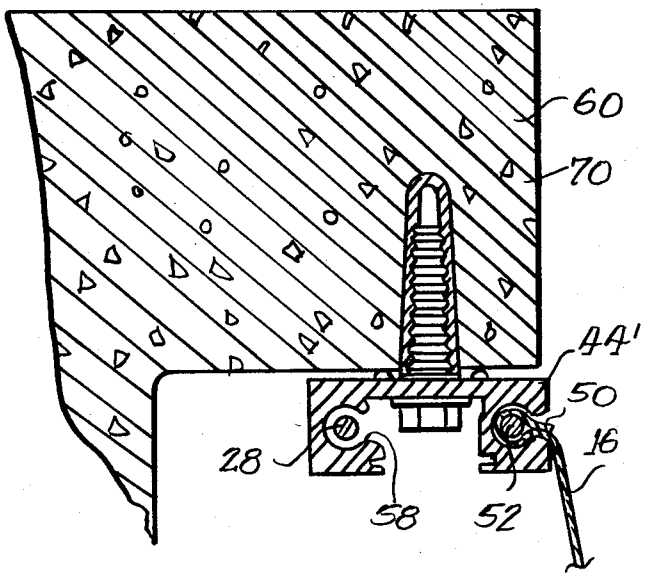
Figure 4B:
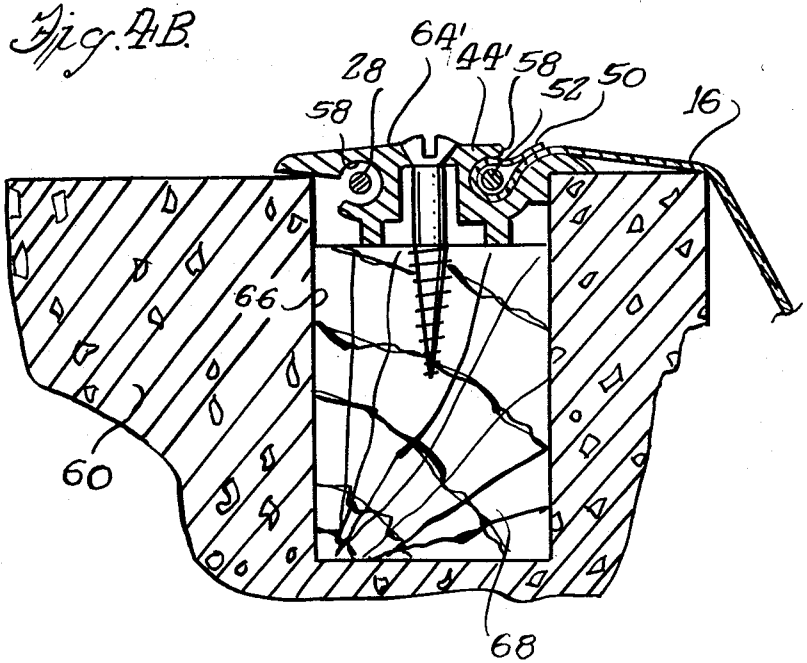
Figure 5:
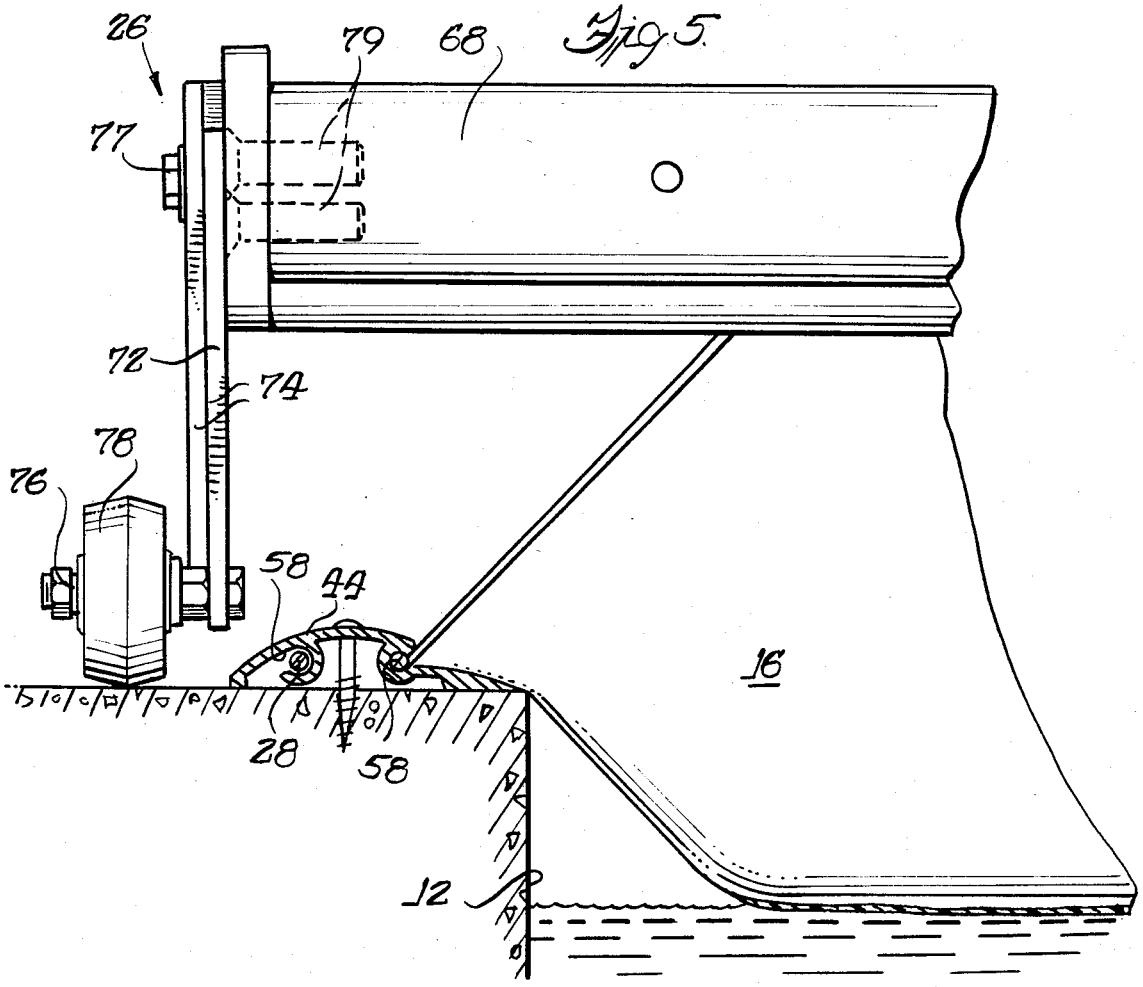
Figure 6:
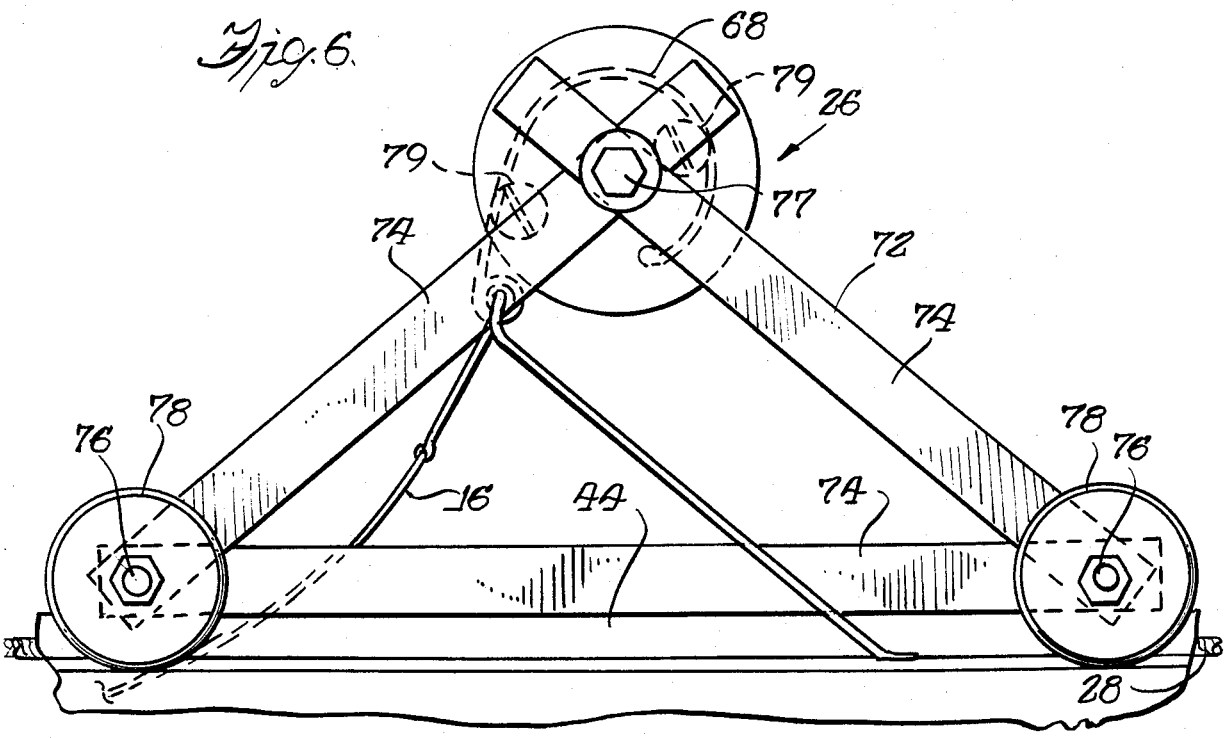

FIG. 4*a* is a cross-sectional view of a guide which may be installed on the deck of a swimming pool;

FIG. 4*b* is a cross-sectional view of a guide which may be installed in the deck of a swimming pool; FIG. 4*c* is a cross-sectional view of tha guide which may be installed beneath the gutter overhang of a swimming pool;

FIG. 5 is a front elevation view of a trolley which is used to draw the cover across the swimming pool;

FIG. 6 is a side elevation view of the trolley; and

Figure 2:
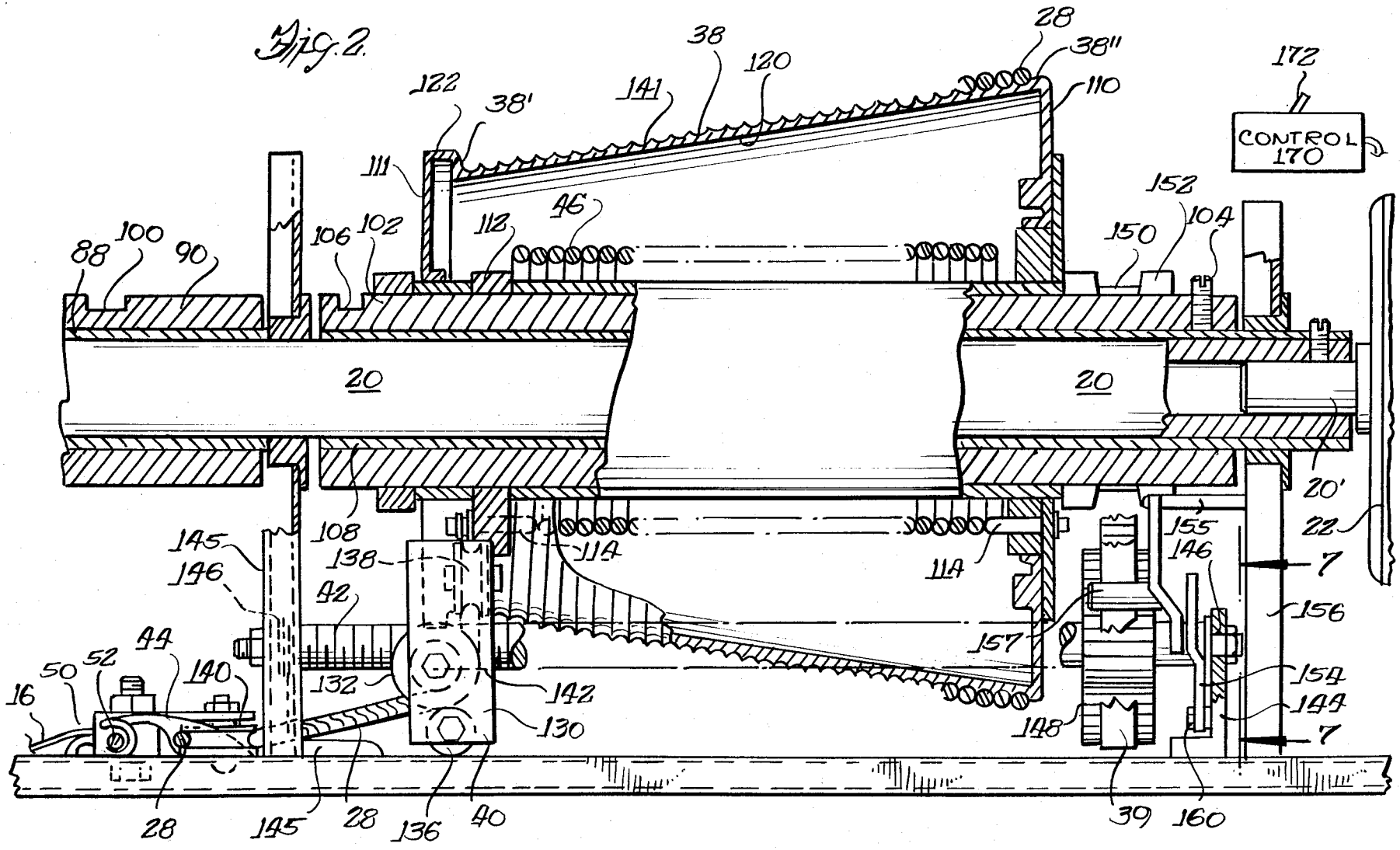
FIG. 2 is a cross-sectional view taken generally along line 2—2 of FIG. 1.
Figure 7:
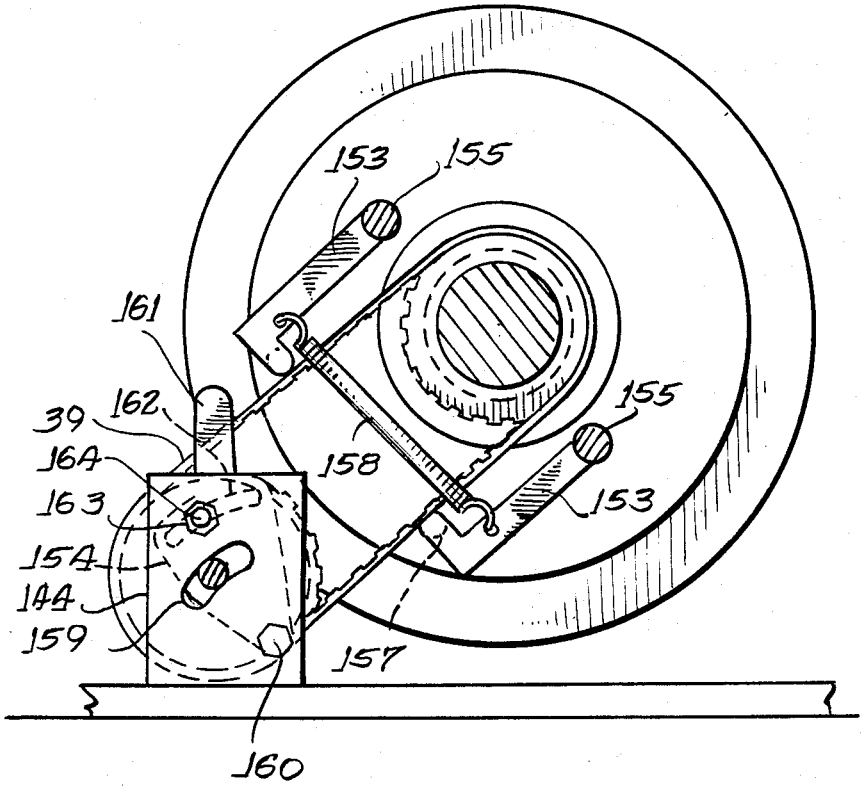

FIG. 7 is a view taken along line 7—7 of FIG. 2.

Figure 1:
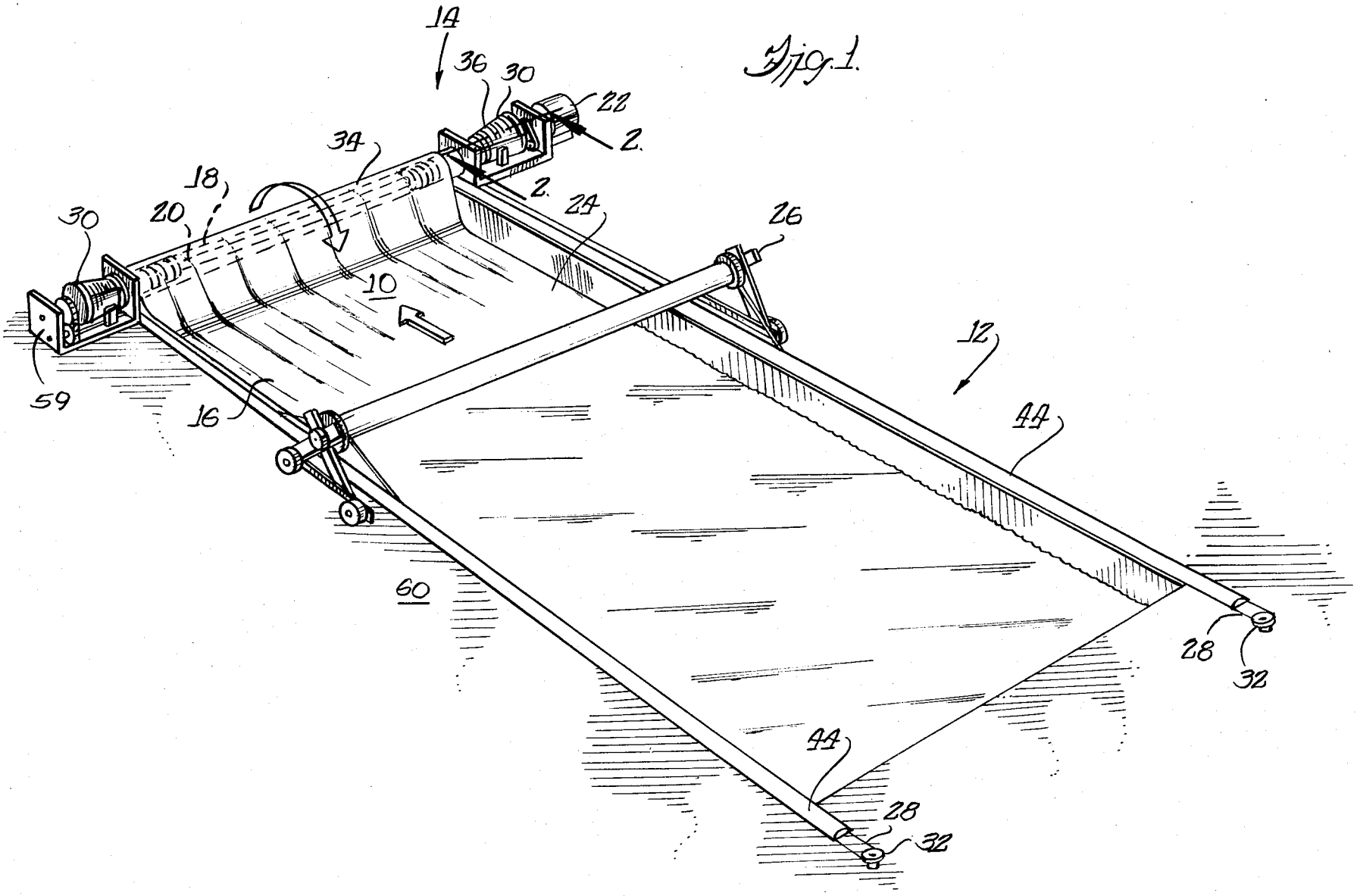
FIG. 1 is a perspective view of a swimming pool having a pool cover and a pool cover winding mechanism that embodies various features of the present invention.

The invention is embodied in an apparatus or cover 10 (FIG. 1) for a swimming pool 12 including a mechanism, indicated generally at 14, in which the cover sheet 16 is reeled and unreeled from a reel or spool 18 disposed around a drive shaft 20 driven by a power means or motor 22, at one end of the pool. A free end 24 of the cover sheet 16 is attached to a trolley means 26 that runs from one end of the pool to the other to cover and uncover the pool as the cover sheet is reeled in or paid out from the spool. The trolley means 26 is pulled in the pool uncovering direction by the sheet that is being reeled into the spool. In order to pull the trolley 26 in the pool covering direction, means in the form of a pair of cable cords 28, one on each side of the pool, are wound about a pair of reels or drums 30 operably connected for rotation along with the motor-driven shaft 20, and preferably disposed around the motor-driven shaft at opposite sides of the spool. The cords 28, each connected at one end to the drum 30 and at the other end to the trolley 26, are entrained around direction-reversing means 32, such as simple pulley wheels at the far end of the pool. The cords are reeled about the drums 30 in the opposite rotational direction from that which the cover sheet 16 is reeled around the spool 18. Thus, when the motor driven shaft 20 is rotated in the direction which pays out sheet 16 from the spool 18, the cords 28 are reeled into the drums 30 pulling the trolley 26 away from the spool end of the pool and carrying the free end 24 of the sheet to the opposite end of the pool 12 to cover the same.

As the sheet 16 is paid out from the spool 18, the cords are reeled about the spools 18 and the diameter of the cover sheet on the reel diminishes in size while the drums 30 are reeling in additional cord. The opposite situation exists when the shaft 20 is rotated in the opposite direction, the diameter of the sheet material on the reel 34 becomes larger as the cord reels 36 pay out the cord. With differences in cord or cover sheet velocity, one side of the sheet tends to lag the other side of the sheet and slack develops in the cover sheet or the cords. Also, variations in tension in the cords or sheet occur as the beaded edges 52 (FIGS. 4*b* & 4*c*) slide in the guides 42 slide along the longitudinal sides of the pool. From whatever the source, variations in tension and velocities between the sheet and the cords or one side of the sheet relative to the other side of the sheet cause binding or slack often with folds occurring that stop sliding of the beaded edges in the guides.

In accordance with the present invention, the velocity of sheet travel is generally equalized with the cord velocity and vice-versa by providing rotatable drums 30, each having a variable diameter surface 38, and positioning each reeling or unreeling cord 28 along the variable diameter surface so that it reels in or pays out in an amount corresponding to the pay-out or reel-in of the sheet 16 from the spool 18. In order to position the cords along the variable diameter surfaces 38 of the drums 30, the surface of each drum 30 varies continuously between a smaller diameter end 38' (FIG. 2) to a larger diameter end 38'', and the cord is precisely guided and laid onto the tapered drum surface by a carriage means 40 that moves from one end of the drum in timed relationship to the reel rotation. Movement of the carriage 40 to coordinate cord 28 placement along the drum surface 38 with sheet reel 34 size change is accomplished by operably connecting the carriage to the motor-driven shaft 20 to travel laterally according to the rotation of the shaft. This is accomplished, in the preferred embodiment, by driving the cord-positioning carriage 40 along the drum surface by a screw means 42 connected by a timing means in the form of a chain or belt 39 to the motor-driven shaft 20.

In addition to trying to match cord and sheet velocities, the present invention attempts to provide constant tension in the cords and in the cover sheet 16. As explained, tension varies. For one reason, the sheet edges run in guide means 44 mounted to the side of the pool deck and friction may vary in the guides as the cover sheet dips into the pool 12 to float upon the surface of the water, an arrangement which, of course, requires that the sheet 16 be wider than the distance between the guides 44 along opposite lateral sides of the pool. When the sheet 16 is reeled onto a spool 18 that is generally slightly wider in the lateral direction than the distance between the two guides 44, folds necessarily develop in the sheet 16 during reel-in. The folds tend to develop differently each time the sheet 16 is reeled in causing the sheet reel 34 to vary in thickness with the same number of spool rotations from reel-in to reel-in. Furthermore, foreign objects, such as leaves, may be entrapped in the sheet reel 34 also altering the thickness of the sheet reel. All of these variables may result in uneven tension in the cover sheet or cord on one side of the pool vis-a-vis the other side of the pool.

In accordance with another aspect of the present invention, biasing means 46, 48 are provided for maintaining the cover sheet and cord under tension to eliminate slack development that can cause sheet folding and binding of a beaded edge in a guide 44. Both the spool 18 on which the sheet 16 is reeled and the drums 30 on which the cords 28 are reeled are connected to the rotating motor-driven shaft 20 by biasing means 48, (FIG. 3), 46 (FIG. 2) which provide for rotation of the spools and drums generally at the speed of the motor driven shaft while compensating for slight variance in tension or rotational speeds of the drums and the spool relative to the shaft 20 and to each other so that additional reel-in or pay-out of the sheet and cords is effected.

In the illustrated embodiment, both the drums 30 and the spool 18 are disposed around the rotating motor-driven shaft 20 and connected thereto for rotation by torsion springs 46, 48 which contract or expand to provide a substantial constant tension on the sheets and cords and to accommodate speed variations between the spool and drums and the driven shaft. Preferably, the sheet 16 and cords 28 are under constant tension and generally free of slack at all times. The springs 48 associated with the spool 18 are coiled to exert tension in the sheet 18 in the sheet reel-in direction while the springs 46 associated with the drums 30 are coiled to exert tension in the cord reeling-in direction, that is, the springs 46 associated with the drums 30 are oppositely coiled from the springs 48 associated with the spool 18 and exert tension in opposite directions. Because the spool springs 48 are connected through the spool 18, sheet 16, cords 28 and drums 30 to the drum springs 46, the springs are at all times biasing against each other, a feature which prevents spring tension from being lost when the motor 22 stops.

So that the invention will be more fully understood, a preferred embodiment will now be described in greater detail.

The sheet 16 may be formed from a variety of strong materials, preferably polymeric in nature so that it will not deteriorate under conditions of substantially continuous contact with chlorinated water.

The sheet 16 is formed with beaded edges slideable in the guides 44 along the lateral sides of the pool 12. The sheet is held sufficiently to support the weight of a person or several persons who might fall onto the covered pool and to prevent the sides of the cover from being lifted by winds allowing debris to find its way under the sides of the cover. The cover sheet 16 is moved in an end-to-end direction with its beaded edges tracking in the guides 44. Herein, the beaded edges are formed by lateral hems 50 at the edge of the sheet looped around cord segments 52 which may be extensions of the cords 28 that are entrained around the drums 30. The free end 24 of the sheet 16 may be attached by means of cord sections 56 to a beam 68 of the trolley that spans the pool.

The guides 44 each have two channels 58 for holding cord segments 28, 52 travelling in opposite directions at the same time. The channels 58 are generally circular in cross section having diameters slightly greater than the diameter of the cord segments 28, 52 and encircling the cord segments to at least about 270° to securely retain the cord segments therein. The precise design of the guides 44 vary depending on whether the guides are to be positioned under the deck, in the deck or on the deck.

Illustrated in FIG. 4A is a guide 44 for on-deck installation, with reference to which the preferred embodiment will be described. This on-deck guide 44 may be installed in both a new or existing pool and is secured to the pool deck 60 by screws 62 extending through the track and into the deck 60 along a lateral side the pool. The guide 44 is configured to provide a rounded upper surface 64, against which persons will not injure their feet when walking by the pool 12.

In FIG. 4B is a guide 44; for in-deck installation, a configuration suitable primarily for new installations where a trough 66 is built into the concrete deck 60 and a beam 68 of a durable wood, such as redwood, is placed in the trough. The guide 44', which is screwed into the beam 68, has a generally flat upper surface 64' which is installed substantially flush with the deck surface.

For below deck installations, as shown in FIG. 4C, a guide 44'' for new or existing installations is secured to an overhang 70 along the pool edge above the gutter region. This guide 44'' has a square configuration which is simple and inexpensive to form and which is suitable for a location where user contact is not of concern.

The illustrated trolley 26 (FIGS. 5 and 6) includes the elongated beam 68 that spans the pool 12 and a pair of side frames 72 each formed of a triangle of bars 74. The frames 72 support the elongated beam 68 at their upper vertices and an axle 76 extends outward of each of the lower frame vertices on which wheels 78 are mounted. The wheels 78 run along the outsides of the cord guides in the case of on-deck 44 or in-deck 44' guides or outward of the sides of the pool 12 in the case of an under-deck guides 44''. Although tracks could be provided for the wheels, generally, as shown herein, the wheels may run freely on the surface of the deck 60 because the tight connection of the beam 68 to the sheet 16 by cord sections 56 maintains the trolley 26 in alignment parallel to the motor-driven shaft 20 and straddling the pool 12. The upper ends of the bars 74 are secured fixedly to a stationary end cap 75 by a bolt 77 and the end cap is secured to the beam by a pair of bolts 79.

At the end of the pool opposite the motor shaft 20 are the cord direction-reversing pulley wheels 32. These are mounted for rotation horizontally in the plane of the guide channels 58 at the ends thereof. Preferably means (not shown) are provided to cover the direction-reversing wheels 32.

Referring again to FIGS. 2 and 3, the mechanism 14 associated with the shaft 20 will now be described in greater detail. Only the mechanism at one lateral side of the pool is shown and described, the mechanism at the other side being substantially a mirror image of the apparatus at the more fully illustrated side except that the shaft 20 terminates in a stationary support 59 (FIG. 1) at the other end rather than being extended from the motor 22 as in the more fully illustrated side.

The motor 22 is either reversible for rotating the shaft in both rotational direction or includes gears appropriate for changing shaft rotational direction. It has sufficient power to reel in the cover sheet 16 even when the sheet is covered with some water or debris. Only one motor 22 is used to drive the drums for the cables as well as the reel for the cover sheet, and there are no clutches for seperately driving the reel or the cable drums, as in the prior art.

Centrally located along the shaft 20 is the reel or spool 18 which is substantially in the shape of a cylindrical tube. One end of the sheet 16 and those segments of cord 52 extended through the hems 50 at the sides of the sheet are attached in conventional manner to the spool 18. The sheet is wound about the spool 18 so that it pays out from the top of the reel 34, whereby leaves and other debris fall from the sheet as the sheet is later reeled in.

The reel or spool 18 (FIGS. 3 and 4) is mounted for movement relative to the driving and support shaft 20 that extends entirely through the hollow cylindrical reel 18. The relative movement is caused or accommodated by a tightening or loosening of the torsion spring 48 whch is operatively connected at one interior end 94 to a spline 88 fastened to the shaft 20 and at its opposite end 95 to an end bell 82 fixed to the outer cylinder or tube 81 of the reel 18. The cylinder 81 is disposed horizontally and is a thin wall metal tube to which the cover sheet end is secured. The opposite ends of the cylinder 81 are capped by the end bells 82 which are fitted into the hollow ends of the cylinders and fastened thereto. More specifically the end bells 82 have short tubular sections 84 that abut the interior wall of the cylinder and are secured thereto and have annular radially extending end walls 86. The end walls have central bores encircling and rotating on a cylindrical surface of a spacer tube 88, preferably formed of polymeric material, such as polyvinyl chloride. The spacer tube 88 allows rotational movement of the end bells 82 relative to an inner tubular spline 90, which during operation of the cover mechanism 14 functions as an integral radial extension of the rotating shaft 20.

The spacer tube 88 serves a bearing for the reel cylinder and is held in its axially located position on the spline by abutting its inner end against a collar 92 on the spline. A retainer ring 93 on the spline abuts the other end of the spacer tube. The torsion spring has its inner end fixed to the collar 92 by insertion through an opening in the collar. The collar is fixedly secured to the spline 90 for rotation therewith. The spring 48 is coiled about and spaced radially outward of the spacer tube 88 with the other end 95 of torsion spring 48 extending through an opening in the end belt wall 86. The spring is coiled in the direction which causes the spring, under tension, to bias the spool 18 relative to the shaft 20 in the sheet winding direction. The springs 48 at each end of the spool 18 transmit the rotational movement of the shaft to the spool but, depending on the relative tension on the spring 48 and on the sheet, cause the spool to rotate ahead or behind the shaft depending on various factors, such as the length of the pool 12.

The spline 90, disposed directly around the rotating shaft 20, provides for adjustment of spring 48 tension. As will be explained, the spline 90 may be unfastened from the shaft 20 and rotated relative to the shaft as well as to the drums 30 to adjust the spring tension. It is intended that the torsion springs 48 associated with the spool 18 as well as those 46 associated with the drums 30 be under tension at all times. The amount of tension on the springs 46 and the balance of tension between the drum springs 46 and the spool springs 48 depends upon the conditions of each installation, and the springs are tensioned at the installation site and adjusted as required thereafter.

The spines 90 are rigidly secured against rotation relative to the shaft 20 by means of set screws 96 extending through threaded bores 98 in the spline for threading into the shaft 20. However, the splines 90 may be released from gripping the shaft 20 by loosening the set screws to remove their inner ends from the shaft 20 in, which case the splines may be rotated relative to the shaft and drums 30 for spring 48 tension adjustment. Radially directed bores 100 are provided in the spline 90 for insertion of a pipe or other tool by which the spline 90 is rotated while holding the spool 18 rotationally immobilized, e.g., with sheet tension or with a wrench. That is, the preferred operation has each torsion spring 48 wound under a preload or tension which is adjusted by turning the spline and the spring end 94 attached to the collar 92 and holding the cylinder and end bell 82 to which is attached the spring end 95. Once, the spring tension desired is obtained the set screws 96 are tightened to lock the spline to the shaft.

Axially outward of the sides of the spool 18 on each side are the cord-reeling drums 30 (FIG. 2) which are connected to the reel shaft 20 in a manner similar to the connection of the spool to the shaft. A separate spline 102 is disposed directly about the shaft 20. Like the spool spline 90, the spline 102 may be rotated relative to the shaft and drum for spring tensioning by loosening set screws 104 and turning the spline with a tool inserted into a radially directed spline bore 106. A cylindrical spacer 108 of polymeric material encircles the spline 102 and journals annular end bells 110 and 111 of the drum 30 for turning relative to the shaft 20 and the spline.

One end 114 of the torsion spring 46 is secured to a collar 112 rigidly secured to the spline 102 for rotation with the shaft 20 and spline. The other end 115 of the torsion spring 46 extends through an opening in drum bell 110. Drum rotation leads or lags shaft 22 rotation depending on the relative tensions on the cord 28 and spring 46. The torsion spring 46 is likewise provided with a preload force or tension and acts in opposition to the preload or tension of the drum springs 48. For instance, if the cable reel spring 46 is wound in the left hand direction, the cover sheet spring 48 is wound in the right hand direction. The spring tensions are used to try to obtain a constant tension force on the cables and also on the cover sheet so that cover sheet and/or cables never become slack. In practice, when slack is noticed on one side of cover sheet, the torsion spring for the sheet on that side of the pool is reset with a higher preload tension by winding the spring further and then refastening the spline to the shaft. The adjustments to the springs 46, 48 are initially made at the time of installation of the cover. Given the number of variables between pools and the installations of the guides 44, trolleys, cords, etc.; it will be seen that the present invention allows initial adjustment to be customized to the particular tensions needed for a given pool at the time of cover installation. The adjustments are made on a trial and error basis until the springs 46, 48 on each side of the pool keep their respective edges of the sheet and cords under tension during protraction and retraction of the cover sheet.

Between its ends 110, the drum 30 has generally the configuration of a frusticonical tube 120 except for an annular radial protusion 122 at the small diameter end wall 111 that prevents the coils of cord 28 from slipping off its inner end. The cord 28 is attached to the greater diameter.

As the sheet 16 pays out lessening the diameter of the sheet reel 34, the cord 28 is caused by the carriage 40 to coil along incrementally smaller portions of the drum surface 38 so that cord reel-in corresponds to sheet pay-out. When the cord 28 is fully coiled, as is the case in FIGS. 2 and 3, substantially covering the drum surface 38, the sheet 16 is fully extended across the pool. Conversely, as the sheet is wound on the reel, the cord is unwound from the smaller diameter grooves on the cord reel. As the spool 18 rotates to reel in sheet 16, enlarging the sheet reel 34, the cord 28 is paid out from increasing diameter grooves of the drum surface 38 on each revolution.

Preferably, each of the springs 46, 48 is prewound to about one-half winding capacity enabling each to contract for greater tension or expand for lesser tension, the varying tensions providing for tension release or slack take-up thereby compensating for any variation in the size of the sheet reel 34 from cycle-to-cycle. Because the connection between the drum spring 46 and reel spring 48 is circuitous, i.e. through the collars 112, 92; splines 90, 102; and shaft 20, as well as through the spool 18, sheet 16, cords 28, and drums 30, the tension on the drum springs 46 and spool springs 48 create opposing biasing forces, holding the cords and sheet under continuous tension.

The carriage means 40 lays the cord smoothly and directly in the spiral groove 141 on the drum surface 38 so that the cord winding is controlled precisely to prevent overlapping of coils or the winding of the cord at one end or the other of the drum. As will be explained, the screw drive 42 for the carriage shifts it longitudenally alongside the drum with a velocity that is matched to the velocity of the cord travel so that the cord is laid squarely and smoothly into the spiral groove and, likewise, is removed directly from the groove in an efficient manner. The carriage comprises a framework 130, pulley wheels 132, 134 carried by the framework to position the reeling cord generally tangential to the drum surface 38 and wheel means 136 on which the carriage travels in a lateral or axial direction along the deck of the pool. The cord 28 at the near end of the guide (for an on-deck guide) is entrained about a horizontally disposed pulley wheel 140 (FIG. 2) changing the direction of the cord to a generally axial direction with respect to the shaft 20. From this pulley wheel 140, the cord 28 rises slightly to where it is entrained around the underside of lower carriage pulley wheel 132 disposed vertically and with its rotational horizontal axis oriented in the end-to-end pool direction, there to the upper carriage pulley wheel 134 disposed vertically and with its horizontal rotational axis parallel to the shaft axis. From the upper pulley wheel, the cord 28 leads in directly to the underside of the groove 141 in the drum surface 38.

Preferably, the surface 38 of the drum 30 has the groove 141 spiralling from one end of the drum to the other. The groove 141 has a lateral width of approximately one cord thickness so that the cord coils around the spool with each coil directly adjacent the next. The drum 30 has sufficient length so that the length of cord corresponding to reeling of the sheet 16 between its extreme positions may be reeled in a single layer in the drum groove 141.

To shift carriage 40, it carries a threaded nut 142 through which is threaded the acme screw 42. The acme screw 42 is journaled for rotation in spaced brackets 144 and 145 at either end of the drum in mounting screws 146 which permit free rotation of the acme screw.

Rotation of the acme screw 42 is coordinated with rotation of the drum 30 by a toothed timing belt 39 transmitting rotation of the motor-driven shaft 20 to the acme screw 42. The timing belt 39 is entrained about a toothed wheel 148 (FIG. 3) connected to the axially outward end of the acme screw 42 and around a toothed wheel 150 secured to the spline 102. The toothed wheel 150 has a pair of spaced annular flanges 152 to hold the belt on the wheel. The toothed timing belt 39 rotates the acme screw in direct timed relationship to rotation of the shaft 20 and the spline 92.

In order that the timing between the shaft 20 and acme screw 42 be maintained during repeated cycles of sheet spreading and retracting, tension is maintained on the timing belt 39 so that there is no slippage between the belt and the toothed wheels 148, 150. Illustrated in FIG. 7 are a pair of arms 153, each mounted at one end for pivotal movement from a shaft 155 extending from a vertical, stationary frame plate 156 (FIGS. 2 and 3) and each having a lug 157 at their free ends pressing against the belt. A coiled spring 158 interconnects the arms 153 adjacent their lugs 157 biasing the arms towards each other so that the lugs apply continuous pressure against opposite sides of the belt 39 thereby assuring sufficient belt tension.

Figure 3:
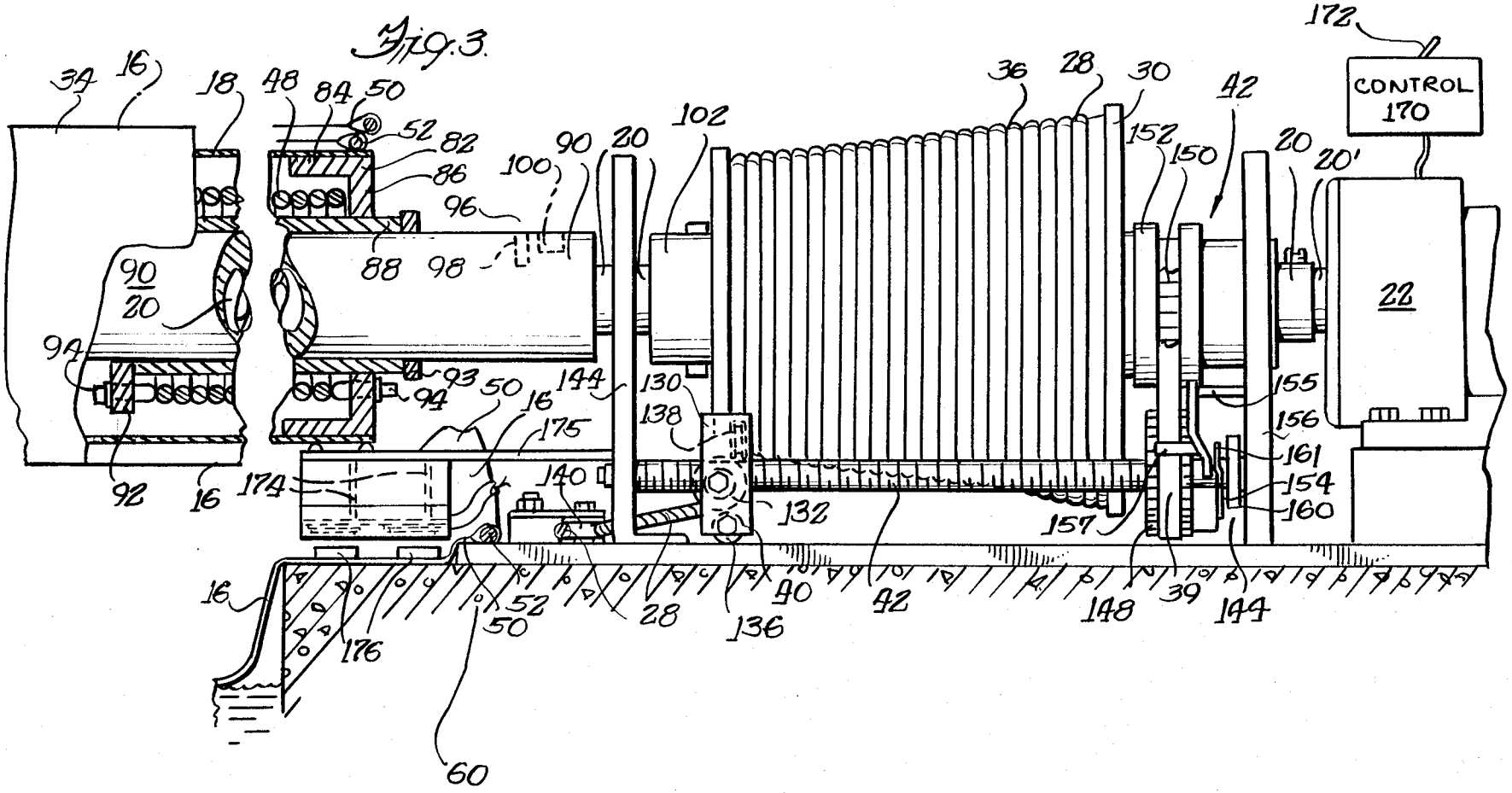
FIG. 3 is an elevation view, partially in section, of one end of the cover winding mechanism of FIG. 1.

Because coordination of drum reel 36 size with sheet reel 34 size depends on factors, such as sheet 16 length, which vary from pool to pool, the initial position of carriage 40 is adjusted at the installation site to be located opposite a particular diameter of the spiral groove. Thus, the position of the carriage may be set initially to left, as seen in FIGS. 2 and 3, to the position it should occupy when the cover is fully wound. As a means of dissociating the toothed wheel 148 of the acme screw 42 from the shaft 20 so that the carraige 40 may be independently positioned relative to the drum 30, the acme screw is mounted at its outer end to be shifted toward the shaft 20 to release the belt for disengagement from the toothed wheel 148 on the screw. The acme screw 42 is movable within its outer end bracket 144 toward or away the shaft 20 along an arcuate slot 159 (FIG. 7) in the bracket. The shaft extends through an adjustment lever 154 that is pivotably mounted to the bracket 144 by means of a shaft 160 below the slot 159. The lever 154 has a handle 161 extending from its upper end. The adjustment lever 154 has an arcuate slot 162 generally concentric with the bracket slot 159, and a nut and bolt 163, 164 assembly extends through an aperture in the bracket and into this slot. To disengage the belt 39 for adjustment purposes, the nut 163 on the bolt 164 is loosened and the handle 161 of the lever 154 moved toward the shaft 20 bringing the toothed wheel 148 of the acme screw 42 closer to the shaft. After appropriate adjustment of the drum 30 and/or carriage 40 by manual rotation of the screw, the lever 154 is pivoted away from the shaft 20 and the nut 163 tightened on the bolt 164 to lock the lever in operating position with the timing belt firmly engaging both the toothed wheels 148 and 150. The initial adjustment is made at pool installation with the diameter of the groove and cord at the start of cover protraction being matched to provide the velocity related to the pool cover at its largest diameter on the reel.

For purposes of asthetics, apparatus protection, and safety, the motor and associated mechanisms including the spool, drums and carriage are enclosed in a housing (not shown) at the spool end of the pool. Also enclosed within the housing is an electrical control 170 (FIGS. 2 and 3) which controls the operation of the electrical motor 22. Covering or uncovering of the pool 12 is actuated by a manual deadman's switch 172, which requires the operator to hold the switch closed in order to energize the motor to operate the mechanism in either the pool covering or the pool uncovering directions. Requiring the operator's attendance during the entire period of sheet reel-in or pay-out should result in the operator giving attention to conditions within the pool and to the smooth functioning of the mechanism.

At the fully covered and fully uncovered positions, limit switches 174 (FIG. 3) are actuated to cause the motor control 170 to stop the motor 22 from reeling or unreeling of the cover. The preferred switches 174 are positioned adjacent the spool and are preferably reed switches fastened to the underside of horizontal bracket 175. Magnets 176 with substantial power are employed as reed switch tripping means being attached to the sheet 16 adjacent its edges for passage in close proximity to the limit switches. Magnets 176 are secured to the sheet at spaced apart locations along the lateral edges of the sheet for tripping the switches at the fully reeled and fully extended positions of the sheet 16. The magnets 176 are sufficiently powerful to trip the reed limit switches 174 even if they pass by the switches somewhat removed therefrom as may occur depending on the folds which form in the reeling sheet. Magnetically operated limit switches 174 have the further advantage of not being tripped by extraneous means in a manner which conventional mechanical limit switches might be inadvertently switched by a foreign object carried by the sheet. Once the limit switches 174 are tripped, the motor control 170 is programmed to require that the mechanism be operated in the opposite direction for a predetermined distance, i.e., a predetermined number of rotations of the shaft 20, before the mechanism 14 can be operated in the direction it was operating immediately prior to limit switch tripping.

The motor control 170 performs other functions as well. One important function that may be conveniently provided by an electronic control unit is automatic unjamming of the mechanism. Because of the various folding patterns which develop, the sheet might fold in a manner which makes it difficult for the mechanism 14 to continue winding in the same direction. If the control 170 receives information of undue resistance, such as might be measured by strain on the motor, it reverses direction of the mechanism for a predetermined amount of sheet travel and then again reverses direction, anticipating that the problem may have cleared itself up. The control 170 may be programmed to completely shut off the motor 22, if after a predetermined number of automatic reversals, the jamming problem has not cleared up. Such an occurance could be caused by a foreign object interfering with the sheet or the cord or as a result of a jam which is not self-correcting. Stopping of the mechanism 14 may be accompanied by a signal which would indicate to the operator that corrective attention is required.

In summary the invention provides a pool cover with a mechanism that trys to match cord and cover sheet velocities and to maintain a constant tension and the cord and cover sheet to prevent slack from developing. The tapered drums and guiding of the cord onto the drums in a precise manner assists in matching cord velocity to cover sheet velocity. The biasing springs used with both the spool and the drums operating in opposition to each other provide better compensation for slack removal. Also, this is highly preferred to mechanisms using a biasing means that acts only on either the drums or the spools because the opposed springs associated with the drums and with the spool herein assure that one spring doesn't turn the motor and create slack when the motor stops.

The limit switches used in conjunction with a deadman's switch assures that the sheet will not be over wound or over extended. The use of magnetically actuated limit switches recognizes and overcomes the difficulty of assuring that the switches will be tripped on each passage of the sheet when reeling in a sheet that is expected to fold during reel-in in a variety of patterns.

While the invention has been described in terms of a preferred embodiment, modifications obvious to one with ordinary skill in the art may be made without departing from the scope of the invention.

Various features of the invention are set forth by the following claims.

What is claimed is:

1. An apparatus for covering a swimming pool or the like comprising:

a cover sheet for covering the pool, a reel for the cover sheet for winding the cover thereon to expose the pool and for unwinding the cover sheet therefrom to cover the pool, motor drive means for driving the reel means to wind the cover sheet thereon and to uncover the pool when the reel is turned thereby in a first direction, cables driven by said motor drive means and connected to the sheet for pulling the cover from the reel and to extend the cover sheet to cover the pool, and cable drum means at each end of the reel driven by said motor drive means and having surfaces varying in diameter for winding of cables thereon and compensating for the reduction in diameter of the cover sheet and preventing slack from developing in the cable or the cover sheet and manually operated independent adjustment means for adjusting the tension in the cables on the respective cable drum means to take up slack in a cable at each end of the reel, a spirally, grooved surface on the conical surface for receiving the cable therein, reel biasing means biasing the reel means in one direction, and drum biasing means biasing the cable drum means in an opposite direction, said biasing means preventing slack from occurring in the cover sheet or the cable means.

2. An apparatus for covering a swimming pool or the like comprising:

a cover sheet for covering the pool, a reel for the cover sheet for winding the cover thereon to expose the pool and for unwinding the cover sheet therefrom to cover the pool, motor drive means for driving the reel means to wind the cover sheet thereon and to uncover the pool when the reel is turned thereby in a first direction, cables driven by said motor drive means and connected to the sheet for pulling the cover from the reel and to extend the cover sheet to cover the pool, and cable drum means at each end of the reel driven by said motor drive means and having surfaces varying in diameter for winding of cables thereon and compensating for the reduction in diameter of the cover sheet and preventing slack from developing in the cable or the cover sheet and manually operated independent adjustment means for adjusting the tension in the cables on the respective cable drum means to take up slack in a cable at each end of the reel, said drive means comprising an elongated drive shaft, first torsion spring means interconnecting the drive shaft and the reel means for biasing the reel means in a first direction, and second torsion spring means interconnecting the cable drum means and the shaft and biasing the cable drum means in an opposite direction.

3. An apparatus for covering a swimming pool or the like comprising:

a cover sheet for covering the pool, a shaft means, a reel means on the shaft means for the cover sheet for winding the cover thereon to expose the pool and for unwinding the cover sheet to cover the pool, motor drive means for driving the shaft means and reel means to wind the cover sheet thereon and to uncover the pool when the reel is turned thereby in a first direction, cable means connected to the sheet for pulling the cover sheet from the reel means and to extend the cover sheet to cover the pool, and cable drum means on the shaft means and driven by said motor drive means and having surfaces varying in diameter for winding of th cable means thereon to compensate for the reduction in diameter of the cover sheet and to prevent slack from developing in the cable means or the cover sheet, reel biasing means biasing the reel means in a first direction to apply tension to the cover sheet, drum biasing means for biasing the cable drum means in a direction opposite to the reel biasing means, said biasing means acting against each other to maintain their respective spring tensions when the motor drive means is not driving the reel means, said reel and drum biasing means acting to take up slack in the cable means or cover sheet during protraction or retraction of the cover sheet.

4. An apparatus for covering a swimming pool or the like comprising:

a cover sheet for covering the pool, a shaft means a reel for the cover sheet on the shaft means for winding the cover thereon to expose the pool and for unwinding the cover sheet thereon to cover the pool, cables connected to the sheet for pulling the cover from the reel and to extend the cover sheet to cover the pool, cable drum means on the shaft means having surfaces varying in diameter for winding of cables thereon and compensating for the reduction in diameter of the cover sheet and preventing slack from developing in the cable or the cover sheet, independent adjustment means at each end of the cover sheet to adjust the position of the drum means relative to said shaft means, a common drive means for the shaft means and drum means to take up slack developing in the cable or in the cover sheet during protraction or retraction of the cover sheet, and biasing means comprising a first torsion spring urging the reel means in one direction and a second torsion spring urging the drum means to turn in the opposite direction.

5. A cover for a swimming pool or the like comprising a sheet of material for covering the pool, spool means connected to one end of said sheet for reeling and unreeling said sheet thereon, trolley means connected to the free end of said sheet for transporting the free end between opposite ends of the pool to alternately cover and uncover the pool, rotatable cable drum means located at each end of the spool means and cord means connected to said cable drum means for reeling and unreeling therefrom, said cord means being connected to said trolley means to pull said trolley means from one end of the pool to the other as said cord is reeled and unreeled, means around which said cord means is entrained at the end of the pool opposite from said cable drum means for reversing the direction of said cord whereby reeling said cord around said reel pulls said trolley means away from said cable drum means to cover said pool, a drive means and a rotatable shaft extending therefrom, said spool means and said cable drum means each being disposed around said shaft, a biasing means for each of said cable drum means, through which said drum means is connected to said shaft for rotation therewith and relative thereto, that biases said cable drum means relative to said shaft in a first rotational direction, said biasing means providing for slight variance in the rotational speeds of said shaft and said cable drum means in order to maintain tension on said cord means at all times, biasing means, through which said spool means is connected to said shaft for rotation therewith, that biases said spool means in a second direction, said biasing means providing for slight variance in the rotational speeds of said spool means relative to said shaft, said first and second biasing means pulling against each other through said cord means and said sheet.

* * * * *